US007490368B2

(12) United States Patent
Procida

(10) Patent No.: US 7,490,368 B2
(45) Date of Patent: Feb. 17, 2009

(54) SPA COVER

(76) Inventor: Carl J. Procida, 9235 Priscilla St., Downey, CA (US) 90242

( * ) Notice: Subject to any disclaimer, the term of this patent is extended or adjusted under 35 U.S.C. 154(b) by 420 days.

(21) Appl. No.: 11/073,821

(22) Filed: Mar. 7, 2005

(65) Prior Publication Data

US 2005/0193484 A1 Sep. 8, 2005

Related U.S. Application Data

(60) Provisional application No. 60/550,904, filed on Mar. 8, 2004.

(51) Int. Cl.
*E04H 4/00* (2006.01)

(52) U.S. Cl. ..... 4/498

(58) Field of Classification Search ..... 4/498, 4/503, 504; 220/200, 218, 694; 428/57, 428/58

See application file for complete search history.

(56) References Cited

U.S. PATENT DOCUMENTS 4,422,192 A 12/1983 Jacobs ..... 4/498
4,857,374 A * 8/1989 Perry ..... 428/71
5,373,590 A 12/1994 Svae et al. ..... 4/499
5,411,782 A * 5/1995 Jarvis et al. ..... 428/57
5,502,939 A * 4/1996 Zadok et al. ..... 52/309.9
5,517,703 A 5/1996 Ouelette ..... 4/498
5,679,432 A * 10/1997 Holmquest et al. ..... 428/71
5,685,031 A * 11/1997 Watkins et al. ..... 4/498
5,974,600 A 11/1999 Pucci et al. ..... 4/498
6,195,811 B1 3/2001 Dragovic
6,393,630 B1 5/2002 Tedrick
6,634,036 B2 10/2003 Tudor
6,665,890 B1 12/2003 Tedrick

* cited by examiner

*Primary Examiner*—Huyen Le
(74) *Attorney, Agent, or Firm*—Kenneth L. Green; Edgar W. Averill, Jr.

(57) ABSTRACT

A spa cover is assembled from two or more molded foam sections. The sections may be molded from polystyrene, polyethylene, or a mixture of polystyrene and polyethylene. Panels are molded into the sections along mating edges, which panels cooperate to align the sections. The sections further include latches for holding the sections in alignment. The sections taper from a peak at the center of the cover to facilitate the run-off of rain, water sprays, or spills. Tie downs or inserts may be molded into the foam to facilitate the use of child safety straps to secure the cover to a spa. The cover may be sized to match known spa sizes, and may include a molded in decorative pattern and/or color.

19 Claims, 11 Drawing Sheets

SPA COVER

The present application claims the benefit of U.S. Provisional Application Ser. No. 60/550,904, filed Mar. 8, 2004, which application is incorporated herein by reference.

BACKGROUND OF THE INVENTION

The present invention relates to spa covers, and in particular to assembleable spa covers comprising a plurality of molded foam sections.

Spas are commonly owned and used to obtain the relaxing benefit of heated circulating water. Spa temperatures may be as high as one hundred degrees Fahrenheit. Either heating a spa to such temperatures, or maintaining such temperatures, may require a substantial use of power. Various spa covers have been devised to retain heat in spas, thereby saving power, and maintain temperatures suitable for use without extensive delays. Unfortunately, due to the size of known spas, a single piece cover is generally to large and heavy for easy manipulation.

U.S. Pat. No. 4,422,192 for "Spa or Hot Tub Cover," describes an insulative cover which folds along a center line to reduce size and improve handling characteristic. The '192 cover comprises a vinyl cover over a foam core. The cover of the '192 patent still must be handled as a single unit and is of a size suitable for a typical spa, and therefore is quite heavy.

U.S. Pat. No. 5,685,031 for "Three-Piece Portable Spa Cover," describes a cover which separates into two or more sections. The sections span across the spa, and are joined by "hinge-like" structure. The sections are made from molded plastic and filled with foam beads. Unfortunately, because the cover sections span across the spa, they are large and cumbersome to handle.

BRIEF SUMMARY OF THE INVENTION

The present invention addresses the above and other needs by providing a spa cover assembled from two or more molded foam sections. The sections may be molded from polystyrene, polyethylene, or a mixture of polystyrene and polyethylene. Panels are molded into the sections along mating edges, which panels cooperate to align the sections. The sections further include latches for retaining the sections in aligned cooperation. The sections taper from a peak at the center of the cover to facilitate the run-off of rain, water sprays, or spills. Holds or inserts may be molded into the foam to facilitate the use of child safety straps to secure the cover to a spa. The cover may be sized to match known spa sizes, and may include a molded in decorative pattern and/or color.

In accordance with one aspect of the invention, there is provided a spa cover comprising at least two sections. Each section comprises a molded foam body, molded-in panels for aligning adjacent sections, and latches for holding the sections in alignment. The foam may be polystyrene, polyethylene, or a mixture of polystyrene and polyethylene. The panels comprise male panels and female panels, and each section may include one of each gender of guide. The sections are preferably functionally interchangeable.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
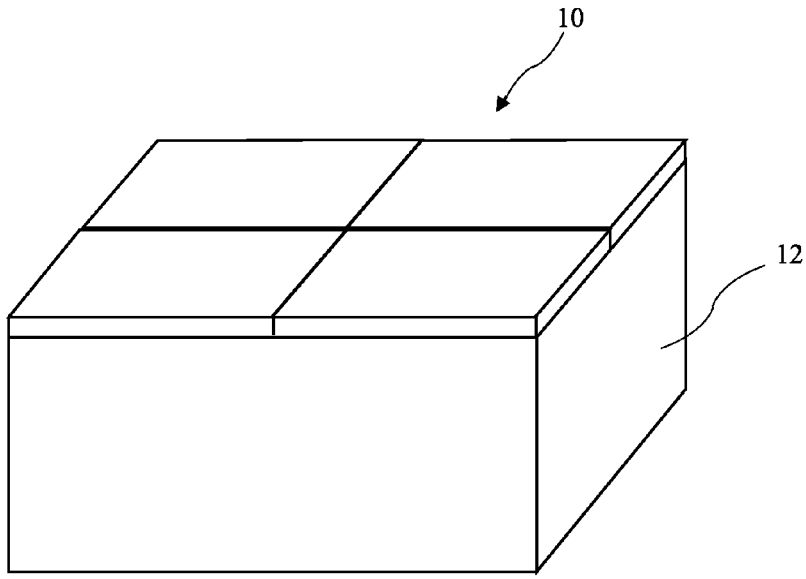
FIG. 1A is a spa with a four section spa cover according to the present invention resting on top of the spa.
Figure 1B:
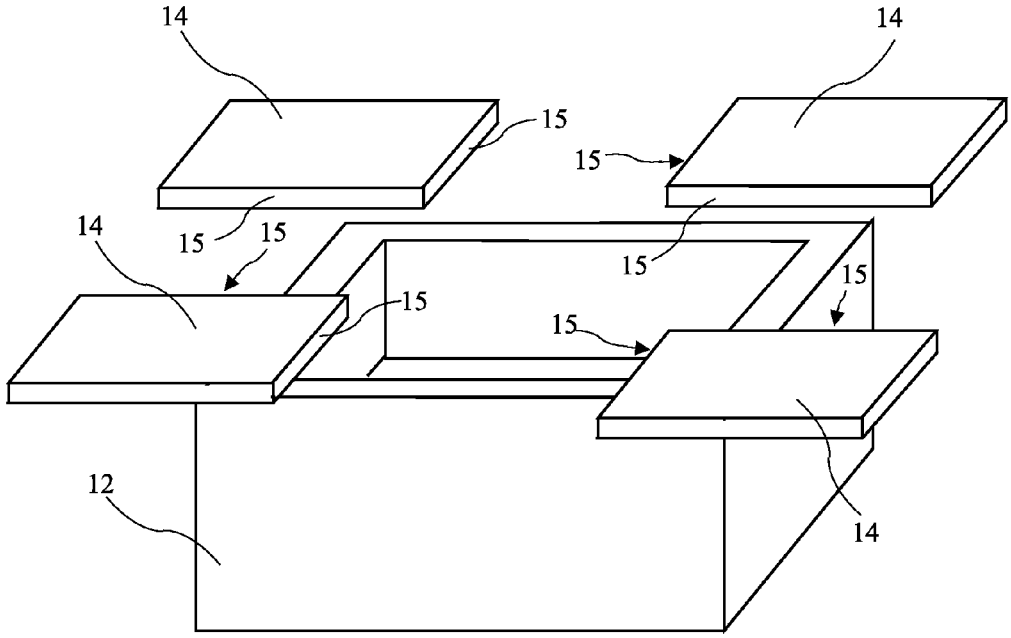
FIG. 1B shows the spa cover separated into four sections.

A spa 12 with four rectangular sections 14 including four corners 10' of a spa cover 10 according to the present invention resting on top of the spa 12 during a period of non-use is shown in FIG. lA. The spa cover 10 may be separated at mating (or engaging) edges 15 into four sections 14 as shown in FIG. 1B for easy handling. The sections 14 are preferable functionally interchangeable. The spa cover 10 is preferably molded from foam which is polystyrene, polyethylene, or a mixture of polystyrene and polyethylene, and more preferably molded from between approximately fifty percent and approximately eighty percent polystyrene and the remainder substantially polyethylene. A preferred material is ARCEL® manufactured by NOVA Chemicals in Alberta, Canada. ARCEL® is a trademark for a moldable copolymer (polystyrene and polyethylene) foam.

Figure 2A:
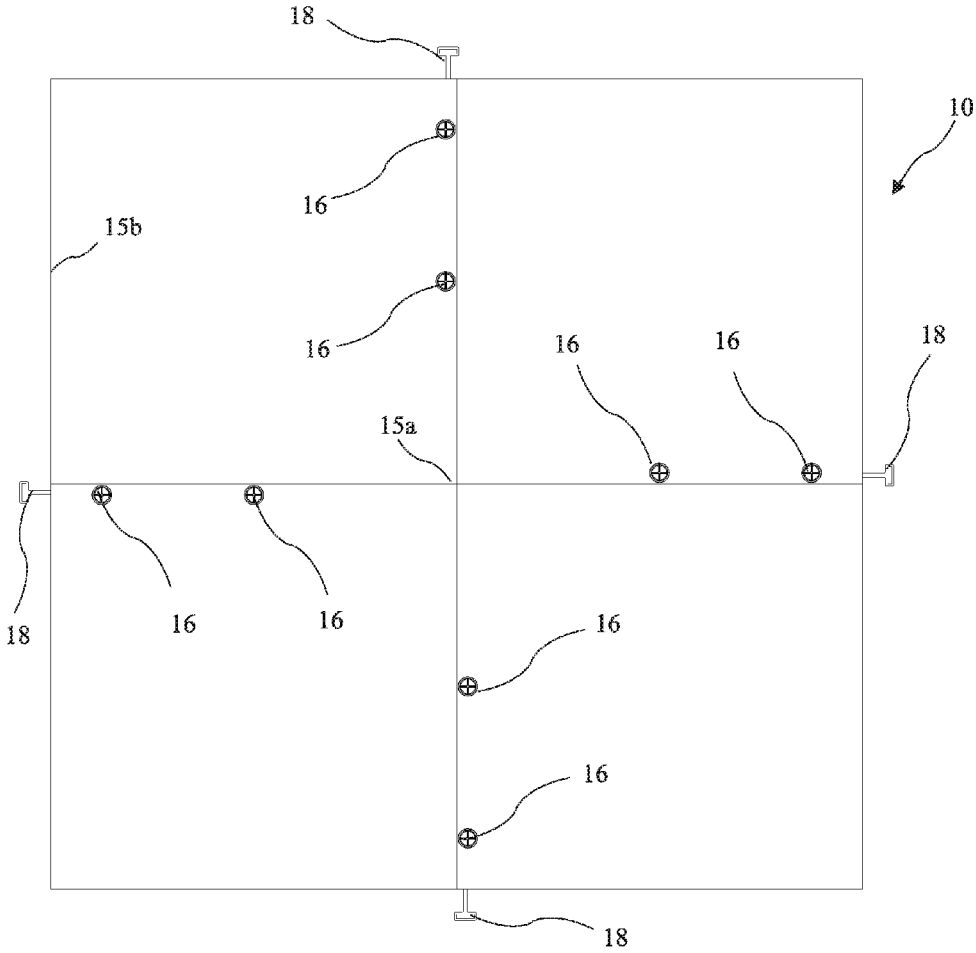
FIG. 2A is a top view of the spa cover showing knobs for engaging latches.
Figure 2B:
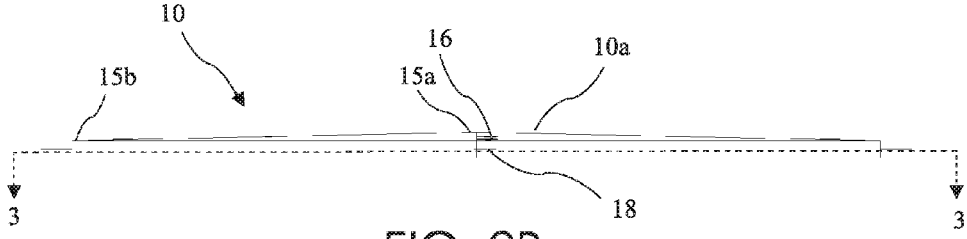
FIG. 2B is a side view of the spa cover showing the knobs for engaging the latches.

A more detailed top view of the spa cover 10 is shown in FIG. 2A, and a side (or edge) view of the spa cover 10 is shown in FIG. 2B. Knobs 16 visible on a top surface 10*a* of the spa cover 10 are provided for actuating latches which hold the sections 14 in alignment. The sections 14 are preferably tapered from a thick inside edge (or point) 15*a* to a thin outside edge 15*b* to facilitate runoff.

Figure 3:
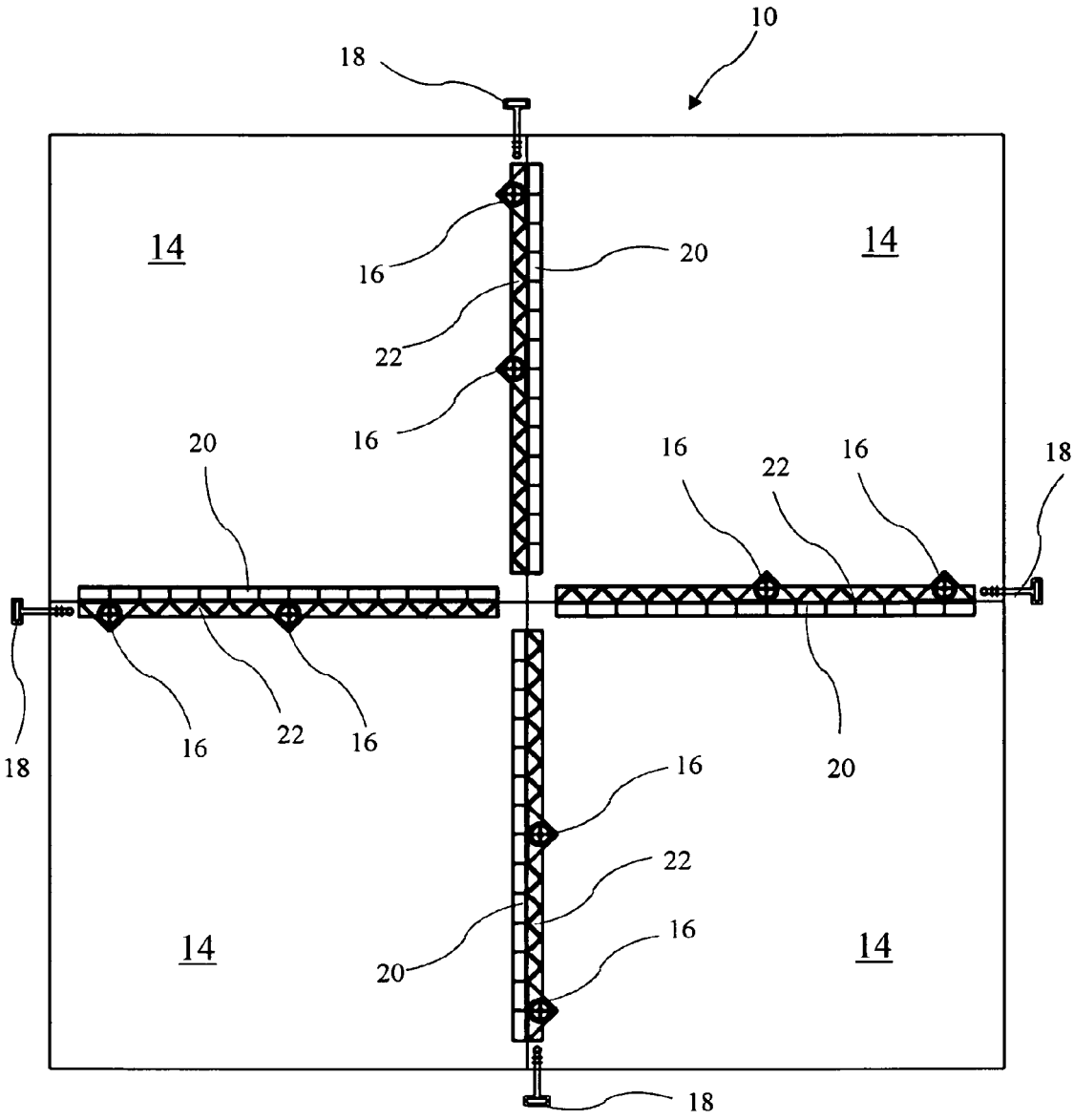
FIG. 3 is a cross-sectional view of the spa cover taken along line 3-3 of FIG. 2B.

A cross-sectional view of the spa cover 10 taken along line 3-3 of FIG. 2B is shown in FIG. 3. Male panels 20 are shown in cooperation with female panels 22 to align the sections 14. The panels 20 and 22 preferably extend between 60 percent and 90 percent of the length of the mating edges 15 of the sections 14, and more preferably extend between approximately 71 percent and approximately 83 percent of the length of the mating edges 15. Pairs of the knobs 16 cooperate with both the male and female panels 20 and 22 to hold the sections 14 in alignment. Tie downs (or inserts) 18 may be molded into the sections 14 to facilitate the use of child safety straps to secure the spa cover 10 to the spa 12.

Figure 3A:
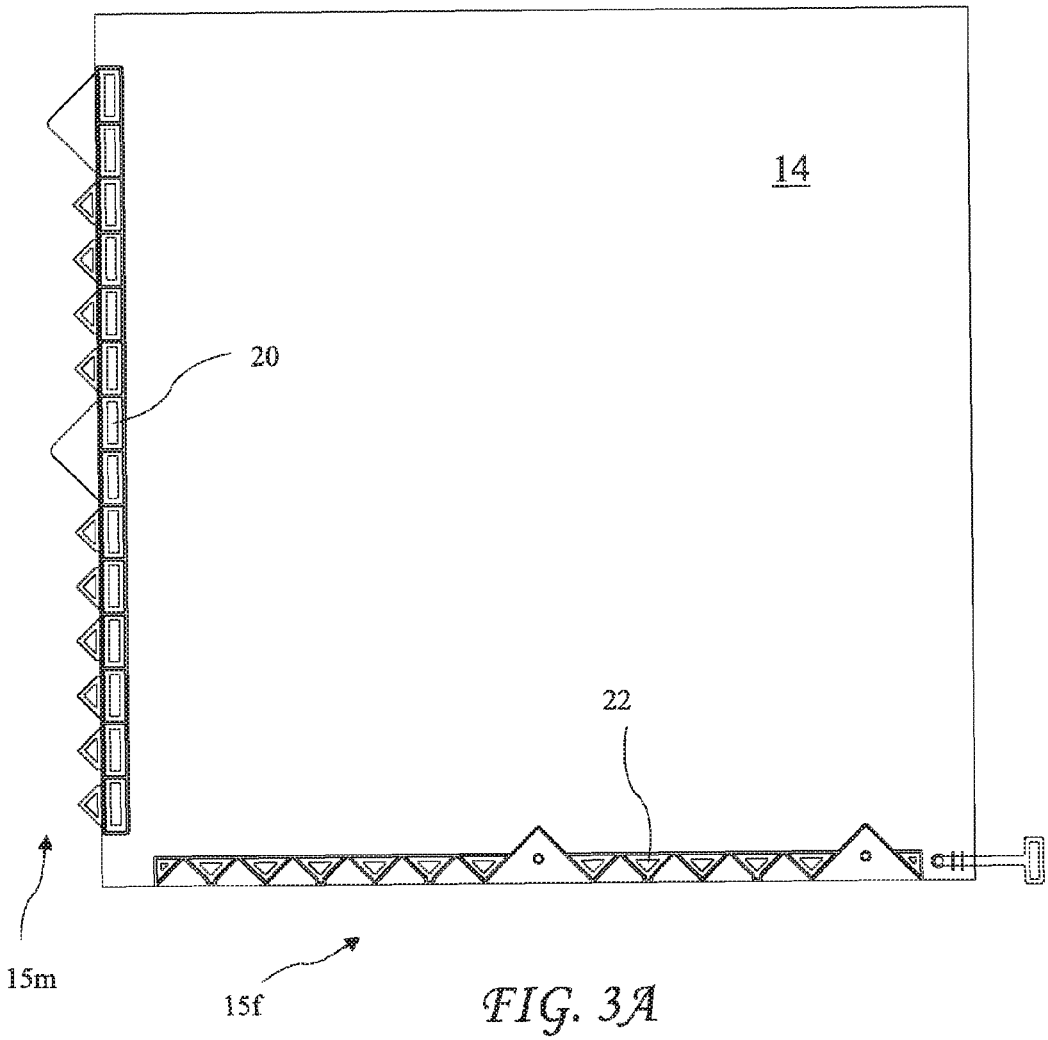
FIG. 3A is a more detailed cross-sectional view of one panel of the spa cover taken along line 3-3 of FIG. 2B.

A more detailed cross-sectional view of one section 14 of the spa cover 10 taken along line 3-3 of FIG. 2B is shown in FIG. 3A. The sections 14 are preferably interchangeable, and it not completely interchangeable, are preferably semi interchangeable (i.e., at least two of a multiplicity of panels making up the spa cover are interchangeable). Each section 14 includes one male panel 20 and one female panel 22 on consecutive edges. The male panel 20 has a male engaging edge 15*m* and the female panel had a female engaging edge 15*f*.

Figure 4A:
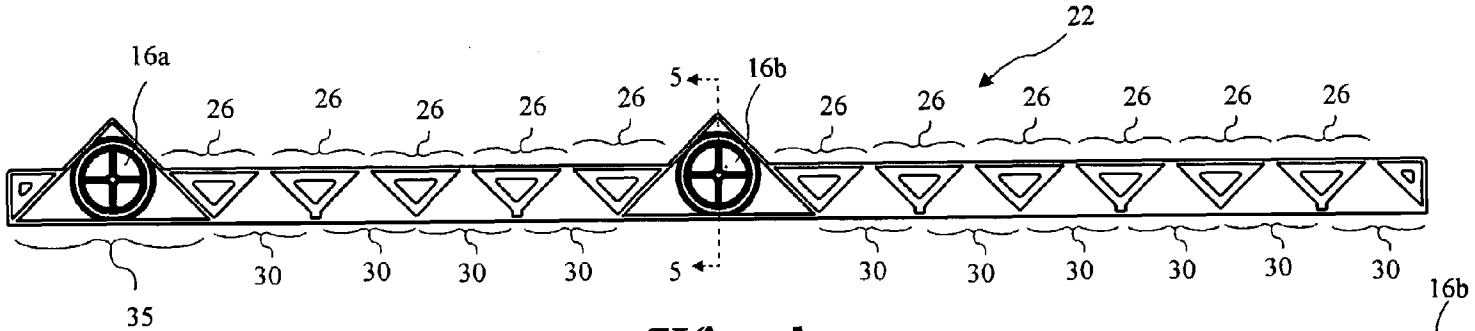
FIG. 4A is a top view of a female panel molded into the sections of the spa cover to align the sections when the spa cover is assembled.
Figure 4B:
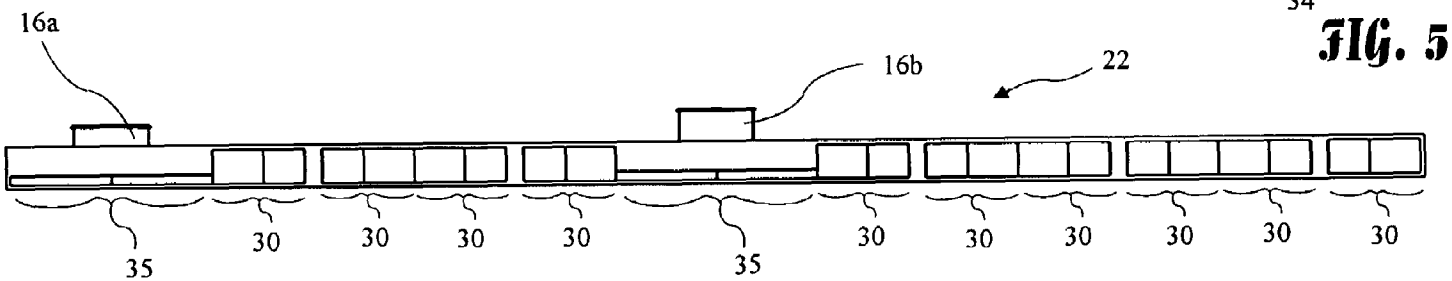
FIG. 4B is a front view of the female panel molded into the sections of the spa cover to align the sections when the spa cover is assembled.
Figure 4C:
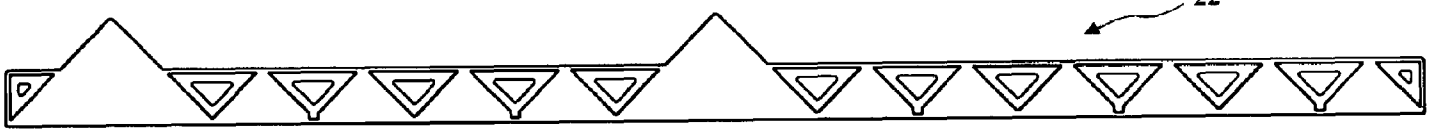
FIG. 4C is a bottom view of the female panel molded into the sections of the spa cover to align the sections when the spa cover is assembled.

A top view showing a horizontal outline of a female panel 22 molded into the sections 14 of the spa cover 10 to align the sections 14 when the spa cover 10 is assembled is shown in FIG. 4A, a front view showing a vertical outline of the female panel 22 is shown in FIG. 4B, and a bottom view of the female panel 22 is shown in FIG. 4G. The female panel 22 includes molded-in portions 26 which cooperate with a foam molding to fix the female panel 22 to the sections 14. The molded-in portions 26 are preferably triangular with a passage though the center to allow the foam material to better grasp the female panels 22. The female panels 22 also include triangular receiving portions 30 having a triangular horizontal cross-section and a rectangular vertical cross section which cooperate with triangular projecting portions 28 having a triangular horizontal cross-section and a rectangular vertical cross-section (see FIGS. 6A, 6B, 7A, 7B, and 8) of the male panels 20 (see FIG. 6*a*) to align the sections 14. Knobs 16*a* and 16*b* reside above slots (or mouths) 35. The receiving portions 30 are preferably approximately one inch high and approximately two inches wide. Tongues 33 (see FIG. 6A) enter the slots 35 as part of the latching of the present invention. The tongues 33 are preferably triangular and subtend an angle 31 of approximately 90 degrees.

Figure 5:
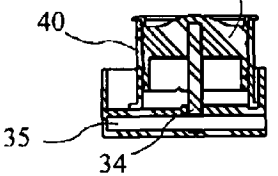
FIG. 5 is a cross-sectional view of the female panel taken along line 5-5 of FIG. 4A.

A cross-sectional view of the female panel 22 taken along line 5-5 of FIG. 4A is shown in FIG. 5. The knob 16*b* resides in a collar 40. A male latch feature 34 extends downward from the knob 16*b*. The knob 16*b* may be advanced into the collar 40 (and thus into the tongue 33) to engage a female latch feature 32 in the tongue 33 (see FIG. 6A) to latch the sections 14 together, and to thereby hold the sections 14 in alignment. The male latch feature 34 is preferably a tapered post or a cylindrical post having a tapered end.

Figure 6A:
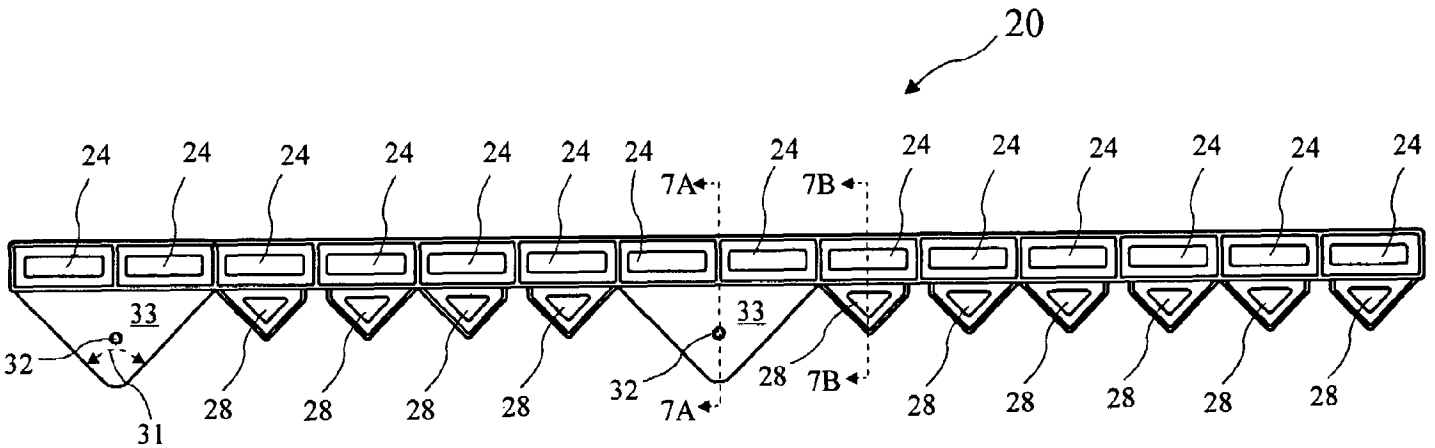
FIG. 6A is a top view of a male panel molded into the sections of the spa cover to align the sections when the spa cover is assembled.
Figure 6B:
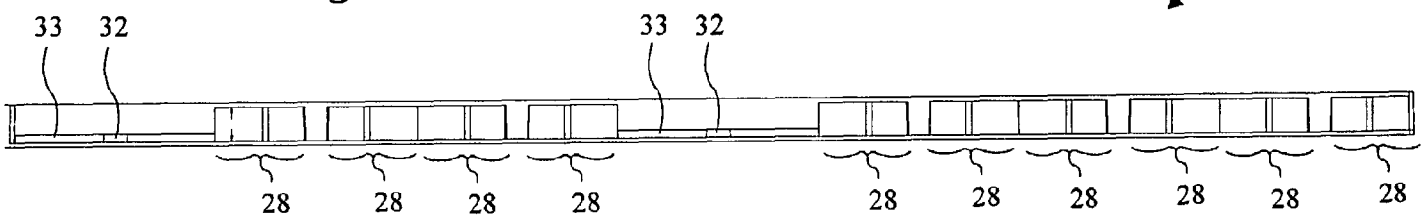
FIG. 6B is a front view of the male panel molded into the sections of the spa cover to align the sections when the spa cover is assembled.

A top view showing a horizontal outline of a male panel 20 molded into the sections 14 of the spa cover 10 to align the sections 14 when the spa cover 10 is assembled, is shown in FIG. 6A and a front view showing a vertical outline of the male panel 20 is shown in FIG. 6B. The male panel 20 includes male molded-in portions 24 which cooperate with a foam molding to fix the male panel 20 to the sections 14. The molded-in portions 24 are preferably rectangular with a passage though the center to allow the foam material to better grasp the male panels 20. The male panels 20 further include projecting portions 28 having a triangular horizontal outline for cooperating with the receiving portions 30 (see FIG. 4A), and triangular tongues 33 for engaging the slots 35 (see FIG. 4A, 4B). The tongues 33 include female latch features 32 which are engaged by male latch features 34 (see FIG. 5) to hold the sections 14 in alignment.

Figure 7B:
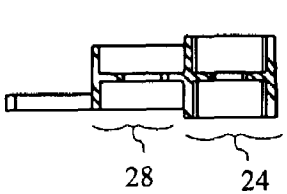
FIG. 7B is a cross-sectional view of the male panel taken along line 7B-7B of FIG. 6A.
Figure 7A:
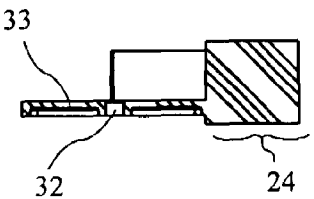
FIG. 7A is a cross-sectional view of the male panel taken along line 7A-7A of FIG. 6A.

A cross-sectional view showing a vertical outline of the male panel 20 taken along line 7A-7A of FIG. 6A is shown in FIG. 7A, and a cross-sectional view of the male panel 20 taken along line 7B-7B of FIG. 6A is shown in FIG. 7B. The female latch feature 32 is preferably a beveled passage through the tongue 33. The projecting portions 28 and the molded in portions 24 preferably have a rectangular side-view (or vertical) cross-section, and are hollow with a horizontal center plates 28*a* and 24*a* respectively having an open center.

Figure 8:
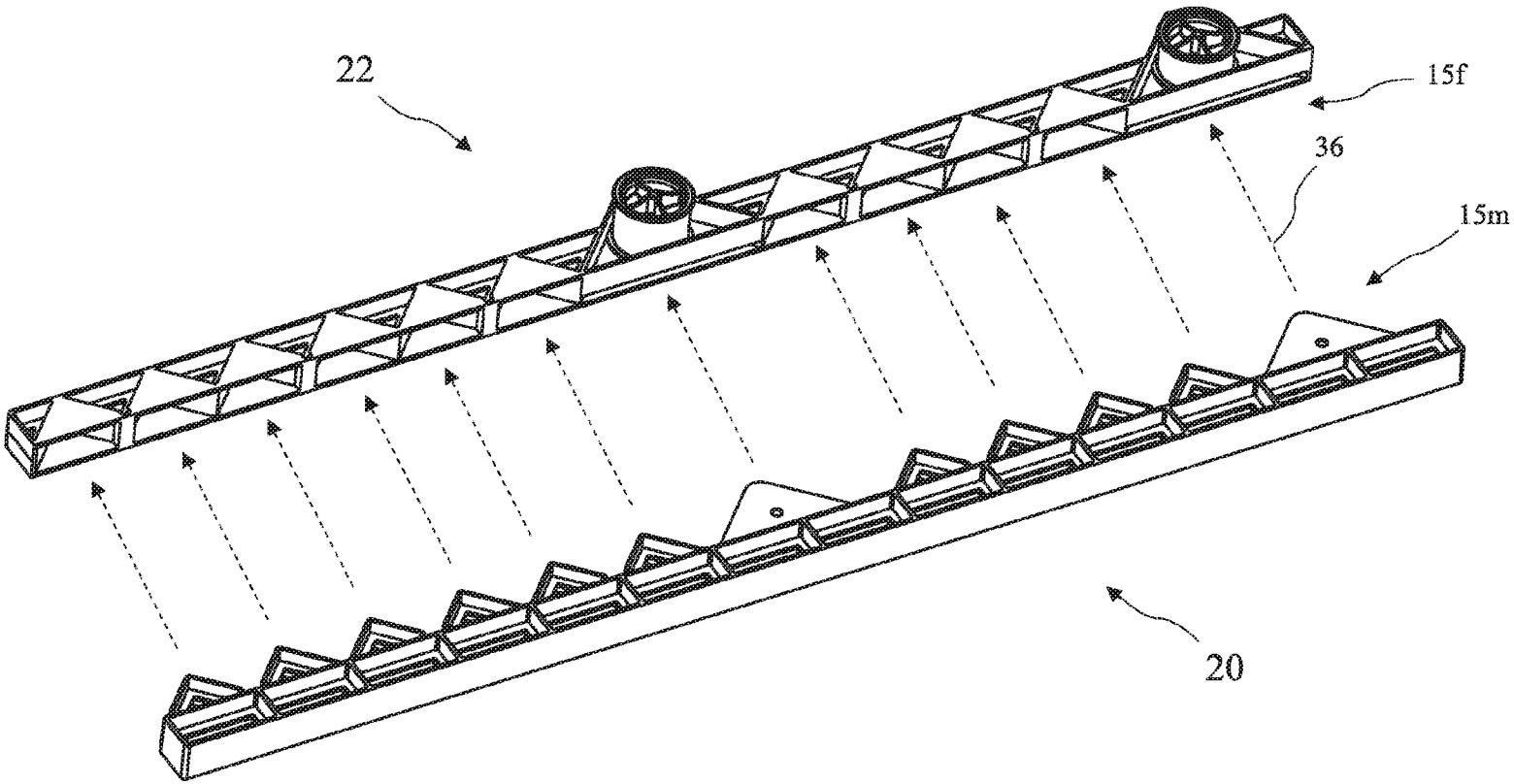
FIG. 8 is a perspective view depicting the cooperation of the male panel with the female panel.

A detailed perspective view depicting the cooperation of the male panel 20 with the female panel 22 is shown in FIG. 8.

Figure 9A:
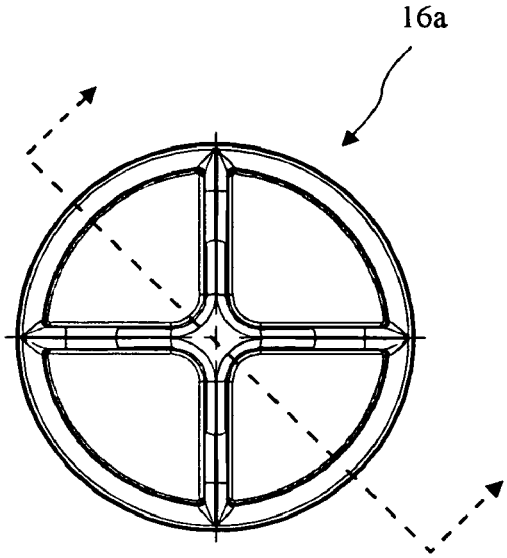
FIG. 9A is a top view of the knob for engaging latches.
Figure 9:
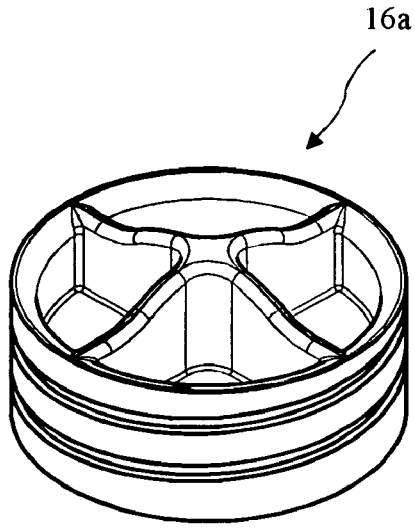
FIG. 9 is a perspective view of the knob for engaging latches.
Figure 9B:
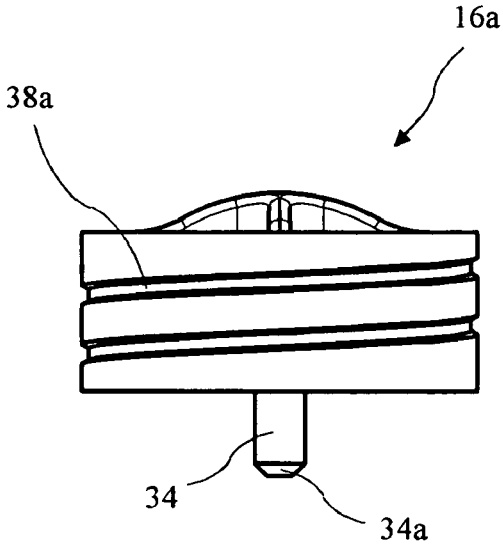
FIG. 9B is a side view of the knob for engaging latches.

A perspective view of the knob 16*a* for engaging latches is shown in FIG. 9, a top view of the knob 16*a* is shown in FIG. 9A, and a side view of the knob 16*a* is shown in FIG. 9B. The knob includes threads 38*a* for cooperating with internal threads 38*b* (see FIG. 12) in the collars 40.

Figure 10:
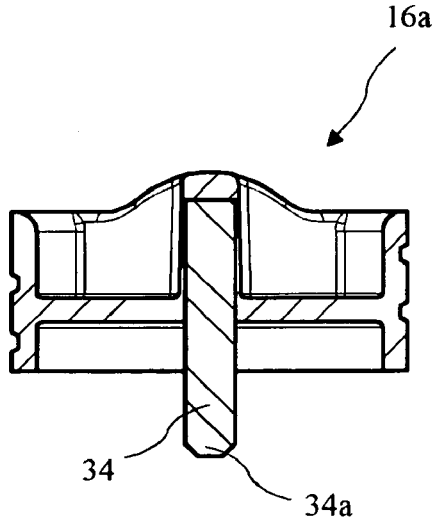
FIG. 10 is a cross-sectional view of the knob taken along line 10-10 of FIG. 9A.

A cross-sectional view of the knob 16*a* taken along line 10-10 of FIG. 9A is shown in FIG. 10. The knob 16*a* includes the male latching feature 34 preferably having a cylindrical body and a tapered end 34*a* for engaging the female latching feature 32 (see FIG. 6A).

Figure 11:
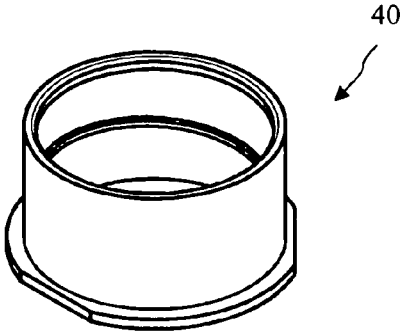
FIG. 11 is a perspective view of a collar for knob.
Figure 11A:
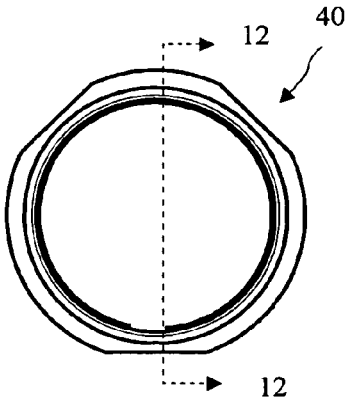
FIG. 11A is a top view of the collar for knob.
Figure 12:
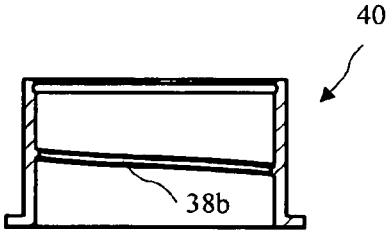
FIG. 12 is a cross-sectional view of the collar taken along line 12-12 of FIG. 11A.

A perspective view of the collar 40 for cooperation with the knob 16*a* is shown in FIG. 11 and a top view of the collar 40 is shown in FIG. 11A. A cross-sectional view of the collar 40 taken along line 12-12 of FIG. 11A is shown in FIG. 12. The collar 40 includes internal threads 38*b* which cooperate with threads 38*a* on the knob 16*a*.

Figure 13:
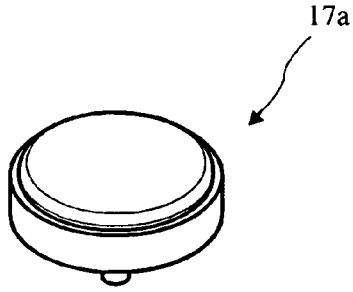
FIG. 13 is a perspective view of a second knob for engaging latches.
Figure 13A:
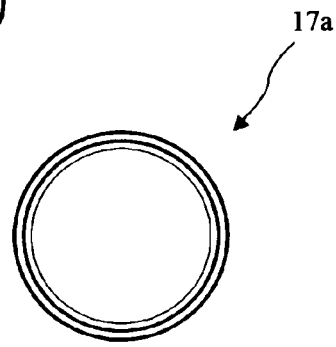
FIG. 13A is a top view of the second knob for engaging latches.
Figure 13B:
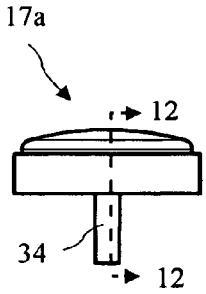
FIG. 13B is a side view of the second knob for engaging latches.
Figure 14:
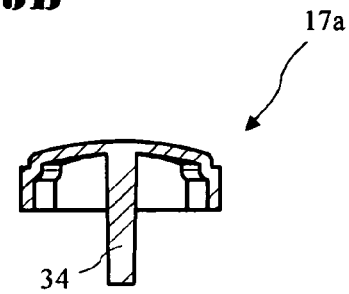
FIG. 14 is a cross-sectional view of the second knob taken along line 10-10 of FIG. 13A.

A perspective view of a second knob 17*a* for engaging latches is shown in FIG. 13, a top view of the knob 17*a* is shown in FIG. 13A, and a side view of the knob 17*b* is shown in FIG. 13B. The knob 17*b* is pressed downward to latch and unlatch the sections 14. A cross-sectional view of the knob 17*a* taken along line 10-10 of FIG. 13A is shown in FIG. 14, showing the male latching feature 34.

Figure 15:
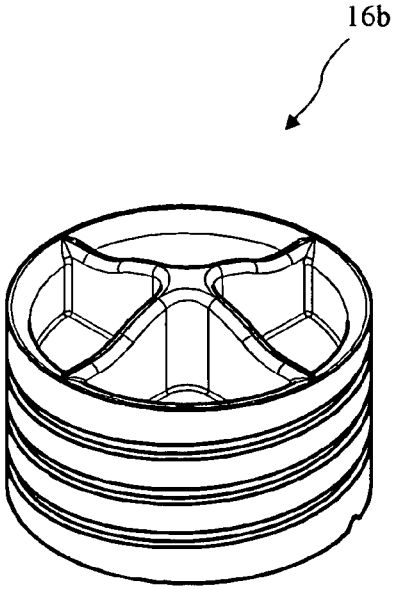
FIG. 15 is a perspective view of a long knob.
Figure 15A:
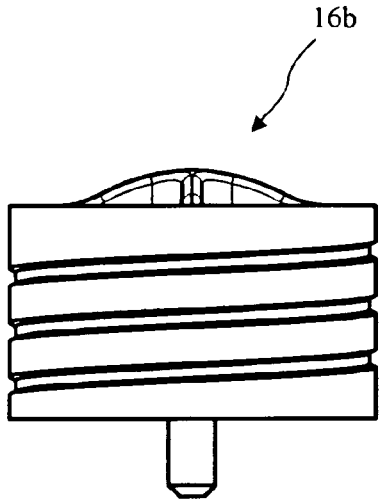
FIG. 15A is a side view of the long knob.

A perspective view of a long knob 16*b* is shown in FIG. 15 and a side view of the long knob 16*b* is shown in FIG. 15A. The knob 16*b* is functionally equivalent to the knob 16*a*, with the exception that the knob 16*b* is used at a thicker portion of the section 14, and is therefore taller than the knob 16*a* (see FIGS. 9, 9A, 9B, and 10).

Figure 16:
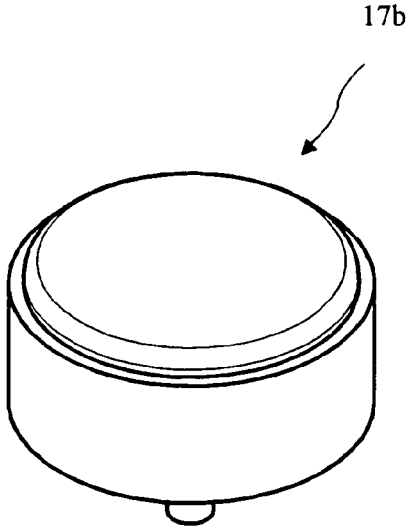
FIG. 16 is a perspective view of a long second knob.
Figure 16A:
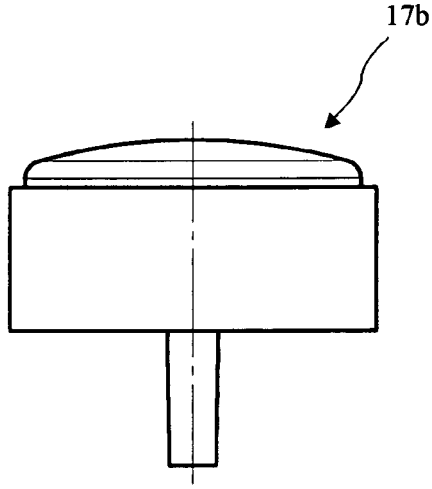
FIG. 16A is a side view of the long second knob.

A perspective view of a long second knob 17*b* is shown in FIG. 16, and a side view of the long second knob 17*b* is shown in FIG. 16A. The long knob 17*b* is similarly used at a thicker portion of the section 14 and is similarly taller than the knob 17*a* (see FIGS. 13, 13A, 13B, and 14).

Figure 17A:
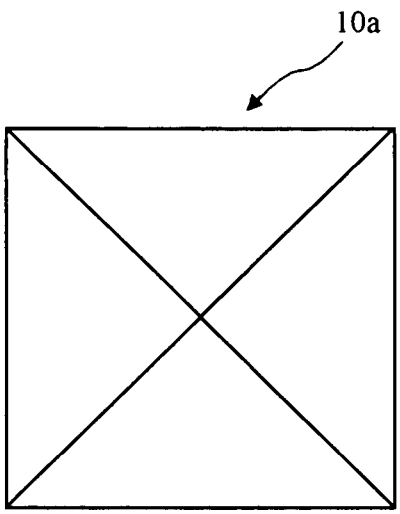
FIG. 17A is an embodiment of the present invention with four triangular sections.
Figure 17B:
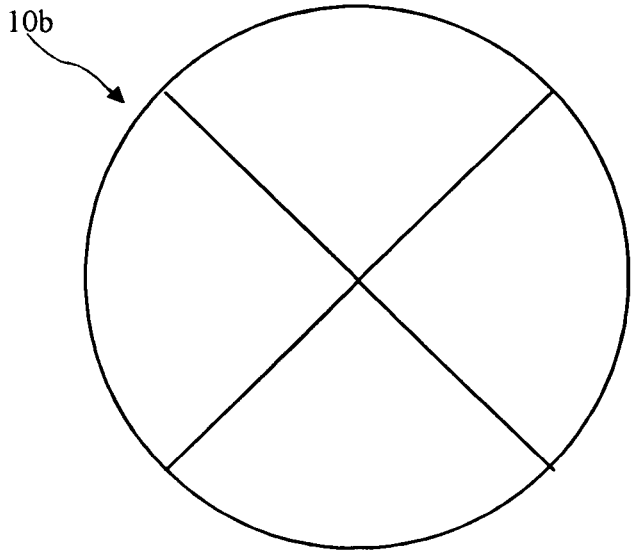
FIG. 17B is an embodiment of the present invention with four pie slice shaped sections.
Figure 17C:
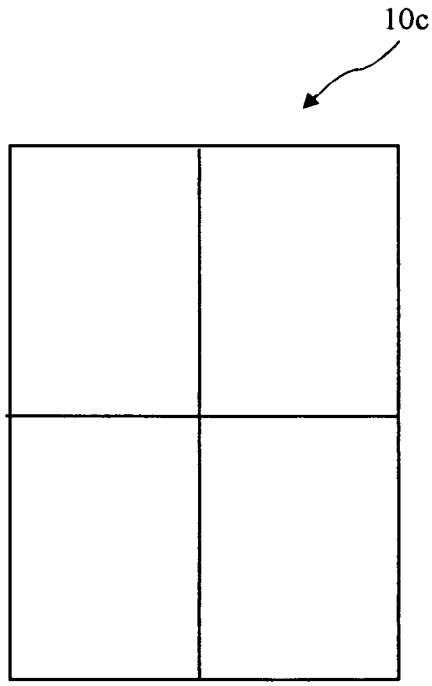
FIG. 17C is an embodiment of the present invention with four rectangular sections.
Figure 17D:
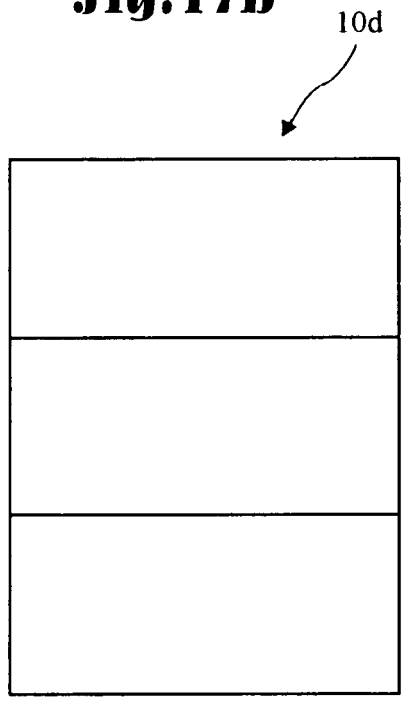
FIG. 17D is an embodiment of the present invention with three rectangular sections.

Various other shaped spa covers may be manufactured according to the present invention, and are intended to come within the scope of the present invention. For example, second embodiment of the present invention with four triangular sections as shown in FIG. 17A, a third embodiment of the present invention with four pie slice shaped sections as shown in FIG. 17B, a fourth embodiment of the present invention with four rectangular sections as shown in FIG. 17C, and fifth embodiment of the present invention with three rectangular sections as shown in FIG. 17D.

While the invention herein disclosed has been described by means of specific embodiments and applications thereof, numerous modifications and variations could be made thereto by those skilled in the art without departing from the scope of the invention set forth in the claims.

I claim:

1. A spa cover comprising:

at least two sections, each section having a molded foam body;

a first engaging edge of a first one of the sections residing adjacent and parallel to a second engaging edge of a second one of the sections when the spa cover is assembled;

panels molded into the engaging edges of the molded foam bodies for aligning and engaging the adjacent sections, the panels including cooperating projecting portions having a triangular horizontal cross-section and receiving portions having a triangular horizontal cross-section; and latches attached to the panels for holding the sections in alignment.

2. The spa cover of claim 1, wherein the foam is a material selected from the group consisting essentially of polystyrene, polyethylene, and a mixture of polystyrene and polyethylene.

3. The spa cover of claim 2, wherein the foam consists essentially of polystyrene and polyethylene.

4. The spa cover of claim 3, wherein the foam comprises between fifty percent and eighty percent polystyrene and the remainder substantially polyethylene.

5. The spa cover of claim 4, wherein the foam is a moldable copolymer (polystyrene and polyethylene) foam.

6. The spa cover of claim 1, wherein each section is tapered from a thick inside edge to a thin outside edge to facilitate runoff.

7. The spa cover of claim 1, wherein the panels comprise cooperating male panels having the projecting portions and female panels having the receiving portions.

8. The spa cover of claim 1, wherein:

the male panels include horizontally residing tongues having a female latch feature; and the female panels include slots for receiving the tongues and a vertically moveable male latch feature, wherein while the sections are residing adjacently, the male latch feature may be advanced vertically into the female latch feature to hold the sections in alignment.

9. The spa cover of claim 8, wherein the male latch features are actuated by knobs residing proximal to an upper surface of the sections, whereby the male latch features are advanced into the female latch features to hold the sections in alignment, and are withdrawn from the female latch features to release the sections from alignment.

10. The spa cover of claim 9, wherein the female latch feature comprises a beveled passage through the horizontally residing tongue and the male latch feature includes a tapered vertical post which engages the beveled passage when the male latch feature is advanced downward.

11. The spa cover of claim 10, wherein the male latch feature further includes a cylindrical body having exterior threads, and the cylindrical body resides in a threaded collar having interior threads in the female panel, wherein turning the cylindrical body in the threaded collar advances the male latch portion to engage the female latch portion.

12. The spa cover of claim 1, wherein the panels extend along the engaging edges between 60 percent and 90 percent of the length of the engaging edge.

13. The spa cover of claim 12, wherein the panels extend along the engaging edges between approximately 71 percent and approximately 83 percent of the length of the engaging edge.

14. The spa cover of claim 1, wherein the panels are constructed from a material selected from a group consisting of plastic and metal.

15. The spa cover of claim 14, wherein the panels are constructed from plastic.

16. The spa cover of claim 1, wherein the sections comprise an even number of sections comprising first sections and second sections, wherein each first section is functionally interchangeable with each other first section and each second section is functionally interchangeable with each other second section.

17. The spa cover of claim 1, wherein each section is functionally interchangeable with each other section.

18. A spa cover comprising:

four interchangeable rectangular sections each including a corner of the assembled spa cover, each section including a molded foam body made from a moldable copolymer (polystyrene and polyethylene) foam and having two consecutive engaging edges;

each engaging edge including one of a molded-in male panel and molded-in female panel for aligning adjacent sections;

the male panels including projecting portions having a triangular horizontal cross-section and the female panels including receiving portions having a triangular horizontal cross-section; and latches residing in the panels for holding the sections in alignment.

19. A spa cover comprising:

spa sections, each section including a molded foam body;

the sections including cooperating molded-in male panels and molded-in female panels for aligning and engaging adjacent edges of the sections;

the male panels including projecting portions having a eon-vex triangular horizontal cross-section; and the female panels including receiving portions having a triangular horizontal cross-section.

* * * * *